United States Patent [19]

Moore

[11] 4,310,940

[45] Jan. 19, 1982

[54] GUTTER CLEANER

[76] Inventor: Edward L. Moore, 5517 Susquehanna Dr., Virginia Beach, Va. 23462

[21] Appl. No.: 80,718

[22] Filed: Oct. 1, 1979

[51] Int. Cl.[3] ..... E04D 13/06

[52] U.S. Cl. ..... 15/105; 15/1; 15/160; 15/236 R; 294/19 R

[58] Field of Search ..... 15/105, 236 R, 160, 15/1, 104 R; 294/19

[56] References Cited

U.S. PATENT DOCUMENTS

| | | | |
|---|---|---|---|
| 2,817,867 | 12/1957 | Bugbird | 15/160 X |
| 2,896,239 | 7/1959 | Bugbird | 15/160 X |
| 3,601,835 | 8/1971 | Morgan | 15/105 |
| 3,626,542 | 12/1971 | Despain et al. | 15/236 R |
| 3,751,749 | 8/1973 | Wilson | 15/92 |
| 4,114,938 | 9/1978 | Strader | 294/19 R |
| 4,143,899 | 3/1979 | Wetherall | 294/19 R |
| 4,196,927 | 4/1980 | Lomaga | 294/19 R |
| 4,200,322 | 4/1980 | Smith | 294/19 R |

*Primary Examiner*—Edward L. Roberts

*Attorney, Agent, or Firm*—Griffin, Branigan & Butler

[57] ABSTRACT

An apparatus for remotely cleaning an overhead gutter (10) includes a first and a second fork (17, 25) disposed near the top of an elongated handle (15). The first fork (17) is stationary with respect to the handle (15) and is slid along the interior of the gutter. The second fork (25) is adapted for rotational motion with respect to the first fork (17) in order to selectively engage debris positioned therebetween. The gutter cleaner also includes a pusher blade (47) mounted on the second fork (25) for cleaning under gutter hanger spikes (10*e*), as well as brush (74) and mirror (78) attachments.

6 Claims, 6 Drawing Figures

GUTTER CLEANER

BACKGROUND

This invention pertains to overhead gutters, and in particular to apparatus designed for cleaning such gutters.

For centuries gutters and downspouts have been installed on buildings in order to properly channel to the ground the water collected on building roofs. Without a gutter, the considerable amount of run-off water from a roof would haphazardly barrage the ground immediately below the roof edge, producing either unsightly erroded trenches or depressed marshy areas. Gutters, on the other hand, when operating efficiently, promote effective drainage of the roof run-off water without these deletrious effects.

There are, unfortunately, several problems commonly associated with gutters. Not only does a gutter serve as a collection medium for water, but also for debris, such as leaves, sticks, and the like, which might be either blown onto a roof or deposited thereon by an overhanging tree. Deposited debris acts as a dam in the gutter and tends to preclude the water contained in the gutter from reaching a downspout. In this situation, the water either stagnates in the gutter or collects to the extent that it haphazardly overflows the gutter, thereby causing the same deletrious effects described above.

Several prior art devices appear to be directed to the problem of cleaning an overhead gutter. These devices typically feature an elongated handle having near its top a means for retrieving debris. However, these devices generally suffer from a number of operational and structural deficiencies. For example, gutters generally contain hangers, such as gutter hanger spikes or the like, for securing the gutter to the building. Cleaning devices that merely enter the gutter from above, particularly those that enter in a sequential side-step, bite-type fashion, are incapable of reaching the debris which may be lodged near or beneath such a spike.

Another problem associated with current gutter cleaning devices is the fact that a properly constructed roof overhangs the gutter, generally by as much as one or two inches. The roof overhang prevents the run-off water from seeping down between the roof and the gutter. However, the roof overhang also serves to obstruct conventional gutter cleaners which generally enter from directly above the gutter. As a result, some of these gutter cleaners are unable to even fit into the gutters. Others are unable to clean the entire width of the gutter, and in particular that portion of the gutter immediately below the roof overhang.

A gutter cleaning tool mounted on an elongated handle may be difficult to operate, especially if the tool is bulky or heavy and if the handle is extended to reach gutters on a multi-story building. Some gutter cleaning devices compound the difficulty by providing a handle to be held in one hand and a tool-controlling rope, or pulley, which must be held in the other hand. Devices of this type necessitate a high degree of operator agility, strength, and balance.

Most gutters are metallic and must be painted and properly maintained to prevent rust and unsightliness. Since painting and maintaining gutters is a painstaking task not relished by most, it is advisable that the operator of a gutter cleaner attempt to avoid unnecessary scraping and scruffing of the gutter. However, gutter cleaners generally are comprised of metallic parts which are prone to scrape and damage the gutters as the cleaners are either sequentially inserted therein or slid along the gutter.

It is usually impossible for an operator to ascertain the location and quantity of debris deposited in a gutter unless he first ascends to the building roof for an inspection. Tools manipulated from the ground rely on the operator's ability to "feel" the debris in the overhead gutter. Often, however, such guesswork is inaccurate and inefficient.

Therefore, an object of this invention is to provide a gutter cleaner capable of cleaning under a roof overhang and beneath gutter hanger spikes.

An advantage of this invention is the provision of a light-weight gutter cleaner which may be simultaneously held and operated in a comfortable, convenient manner.

Another advantage of this invention is the provision of a gutter cleaner which may be easily slid along the length of a gutter.

A further advantage of this invention is the provision of a gutter cleaner which does not scrape or scar the exterior surfaces of a gutter.

Still another advantage of this invention is the provision of means to allow an operator to readily and visibly locate debris deposited within a gutter.

SUMMARY

The foregoing objects and advantages are satisfied and the foregoing deficiencies are overcome by the present gutter cleaner which comprises a pair of forks disposed near the top of an elongated handle. A first fork is stationary with respect to the handle and is slid along the interior of the gutter. A second fork is adapted for rotational motion with respect to the first fork in order to selectively engage debris positioned therebetween.

Both the first and the second forks are inclined at an acute angle with respect to the handle in order for the cleaner to properly fit into a gutter and beneath a roof overhang. As a result, the apparatus is able to clean the entire width of the gutter.

Mounted on the second fork is a pusher blade which may be slid under gutter spikes and the like as the apparatus is slid along the gutter. The pusher blade enables the apparatus to dislodge debris deposited under the gutter spikes.

The present gutter cleaner employs a plurality of plastic rollers which permit the cleaner to be slid along the gutter. Advantageously, the plastic rollers are the only working surfaces which contact the exterior of the gutter. Consequently, the present gutter cleaner is not prone to scar or damage the gutter.

The rotatable second fork is operated by an elongated rod ultimately controlled near the bottom of the elongated handle. The operator may conveniently position his hands in close proximity on the handle, using one hand to control the rotatable motion of the second fork and both hands to impart sliding motion to the apparatus along the gutter.

Further, the gutter cleaner described hereinafter may be used in conjunction with two accessories. The first accessory is a brush for sweeping the gutter; the second is a mirror mounted so as to provide the operator below with a view of the gutter and the debris deposited therein. Since the mirror accessory is ultimately attached to the second fork, as the second fork is rotated and the viewing angle thereby changed, the operator is able to see more of the gutter interior.

BRIEF DESCRIPTION OF THE DRAWINGS

Other objects and advantages of the present invention will become apparent to those skilled in the art as the following detailed description is studied in conjunction with the following drawings in which.

DETAILED DESCRIPTION OF THE DRAWINGS

Figures 1, 5, 6:
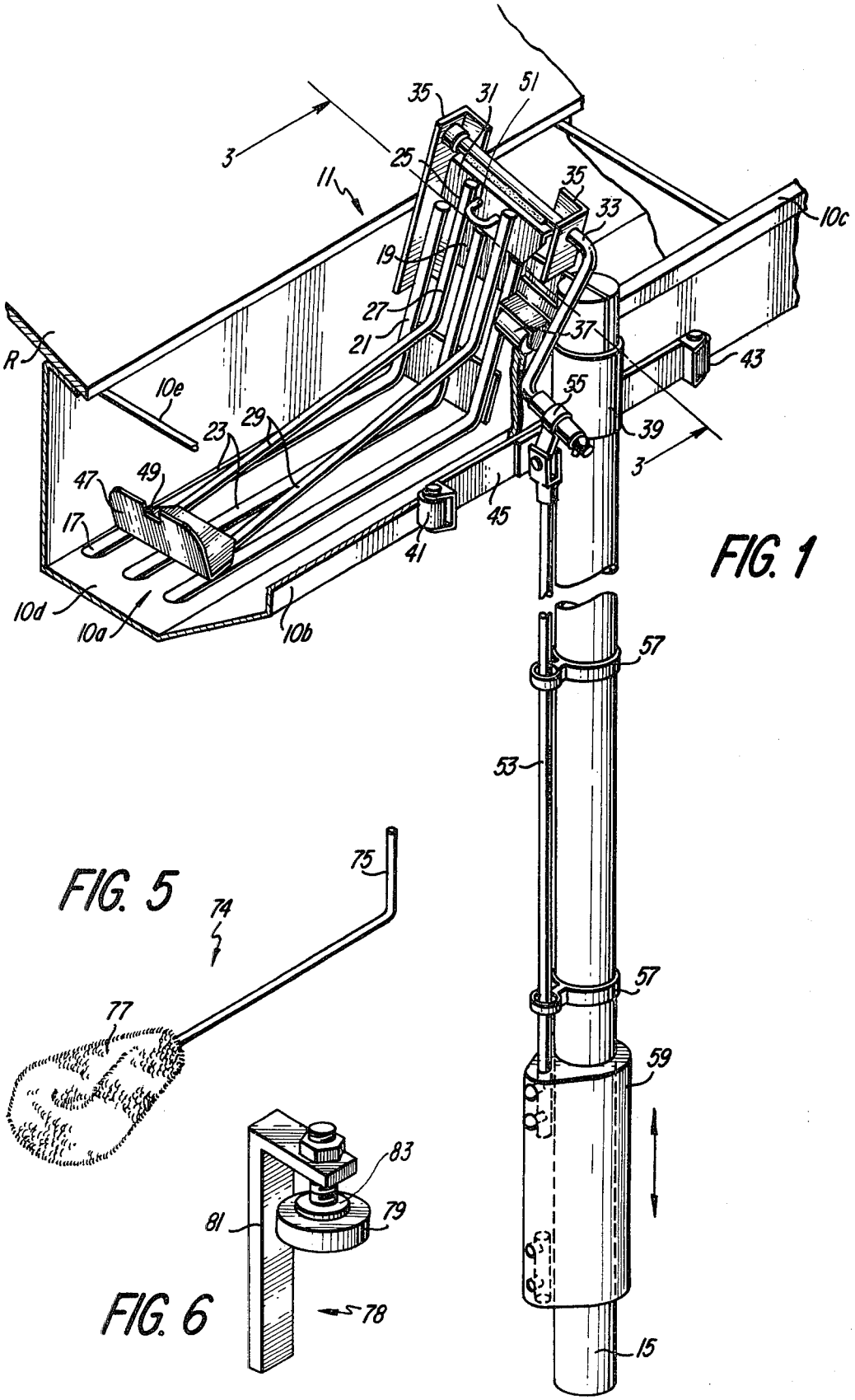
FIG. 1 is a perspective elevation of a portion of the invention.
FIG. 5 is a schematic view of a brush accessory.
FIG. 6 is a schematic view of a mirror accessory.

FIG. 1 illustrates a typical roof gutter 10 having an interior 10*a*, an exterior side 10*b*, a top edge 10*c*, and a bottom 10*d*. The gutter 10 is affixed to a building (not shown) beneath an overhanging roof R thereof by means of a gutter spike 10*e*.

The gutter 10 of FIG. 1 shows a gutter cleaner apparatus 11 positioned therein. The apparatus 11 is supported by an elongated handle 15 held by a person on the ground (not shown).

The gutter cleaner apparatus 11 has a first fork 17 rigidly mounted to the elongated handle 15 by a first bracket 19. The first fork 17 has a substantially vertical portion 21 and a horizontal portion 23. A second fork 25 having a substantially vertical portion 27 and a horizontal portion 29 is mounted to a second bracket 31 which is secured to a crank shaft 33. The crank shaft 33 is rotatably mounted in two crank support plates 35 which are secured to the first bracket 19 so as to support the crank shaft 33 above the first bracket 19.

The gutter cleaner apparatus 11 has a first roller 37 mounted to a lower edge of the first support bracket 19. A second roller 39 encircles the elongated handle 15 at its top just below the first bracket 19. Two other vertical rollers, or stabilization rollers 41 and 43, are secured to the ends of a brace 45 which is transversely mounted to the elongated handle 15 in a position just below the second roller 39. The rollers 37, 39, 41, and 43 are preferably of plastic.

A pusher blade 47 is mounted perpendicularly to the distal end of the horizontal portion 29 of the second fork 25. The pusher blade has a notch 49 cut in its upper edge to support an accessory. Fastening means, such as U-bolt fastener 51, is mounted through the bracket 31 of the second fork 25 for securing an accessory thereto.

An elongated control rod 53 is attached to the end of the crank 33 by a pivotable bracket 55 which prevents the elongated control rod 53 from binding the crank shaft 33 as it rotates up to its horizontal position. The elongated control rod 53 is slidably secured to the elongated handle 15 by clamp brackets 57 and attached at its lower end to an operator's control handle 59 which slidably encircles the elongated handle 15.

Figure 2:
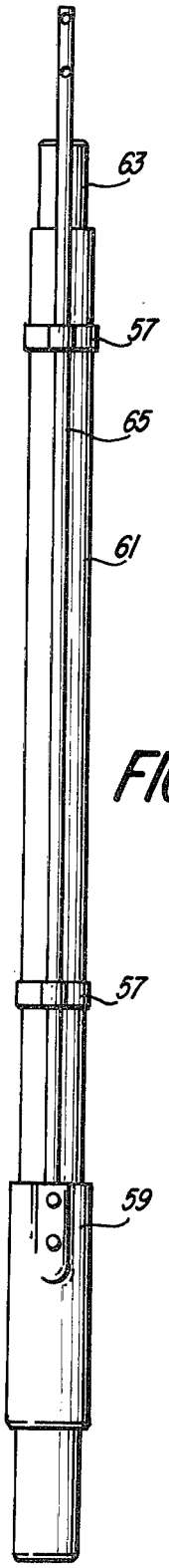
FIG. 2 is an elevation of the supporting handle and control for the present invention.

FIG. 2 illustrates an extension handle 61 secured by an insert dowel 63 to the lower end of the elongated handle 15. The extension handle 61 has a control rod extension 65 which attaches to the lower end of the elongated control rod 53 and is held to the extension handle 61 by additional clamp brackets 57. The lower end of the control rod extension 65 is attached to another operator's control handle 59. In this respect, however, other types of appropriate handle extensions may be used in conjunction with the invention.

Figure 3:
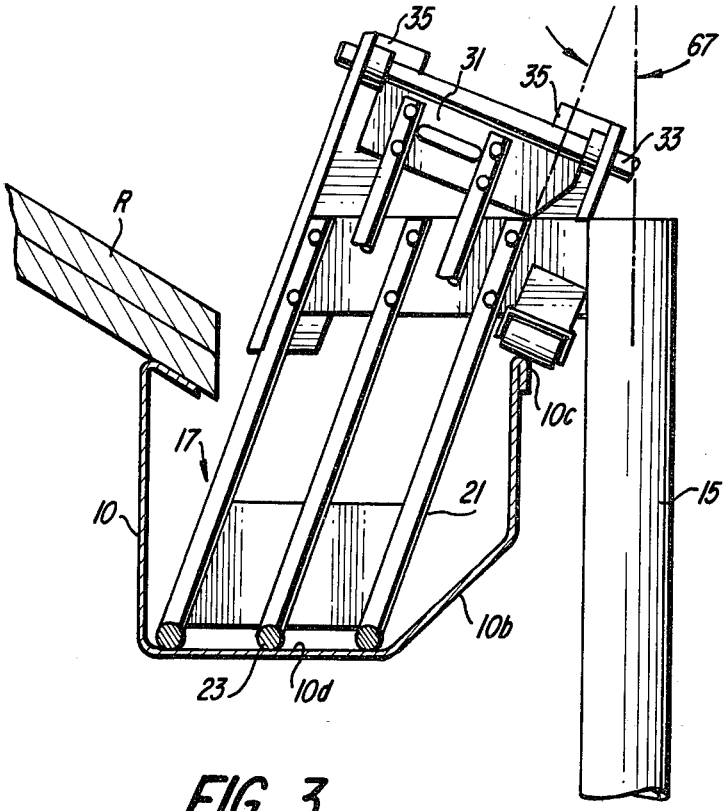
FIG. 3 is a partial section taken along lines 3—3.

With reference to FIG. 3, it can be seen that when the vertical portion 21 of the first fork 17, the vertical portion 27 of the second fork 25, and the elongated handle 15 all lie substantially in the plane of the paper, both the vertical portion 21 of the first fork 17 and the vertical portion 27 of the second fork 25 intersect at an acute angle 67 with the elongated handle 15. The size of the acute angle 67 basically corresponds to the angle the gutter exterior side 10*b* makes with the gutter bottom 10*d*. In one embodiment angle 67 is approximately 20°.

Figure 4:
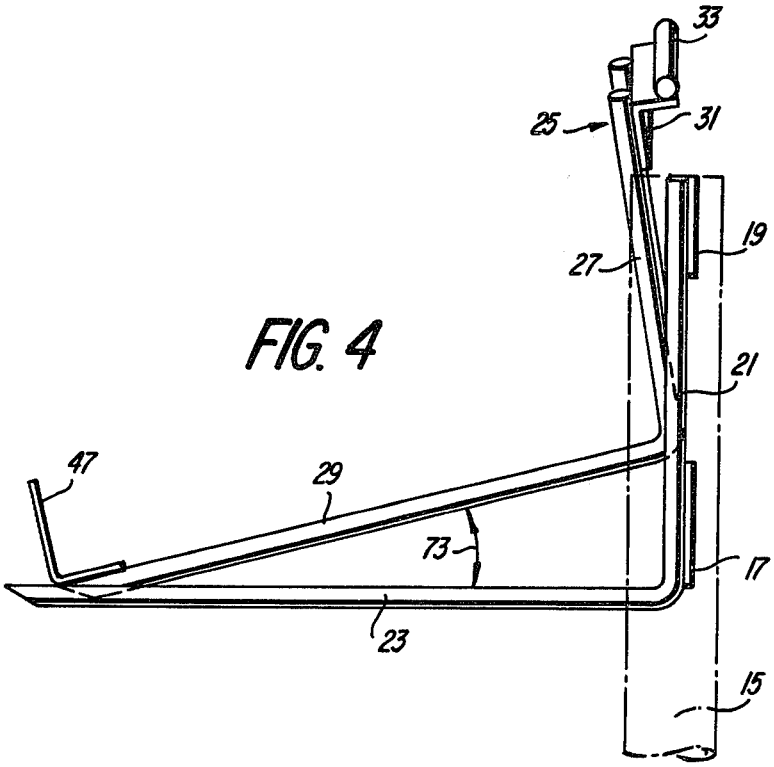
FIG. 4 is a side view of selected portions of the FIG. 1 structure illustrating an angular relationship therebetween.

Referring to FIG. 4, the horizontal portion 29 of the second fork 25 forms an acute angle 73 with the horizontal portion 23 of the first fork 17 when the vertical portions 21 and 27 are together (the second fork 25 being rotated to its essentially closed position).

Various accessories may be mounted on the apparatus 11 by means of U-bolt fastener 51. For example, a brush accessory 74 (See FIG. 5) having an L-shaped extension handle 75 may be secured to the second fork 25 by the U-bolt 51. A portion of the handle 75 near the brush 77 rests in the notch 49 of the pusher blade 47 so that brush 77 projects downwardly into the gutter and beyond the first fork 17.

Alternatively, U-bolt 51 may mount a mirror accessory 78 (See FIG. 6) to the second fork 25. The mirror accessory 78 comprises a mirror pivotably mounted to a second L-shaped extension rod 81 by ball joint 83.

In operation, an operator on the ground uses the elongated handle 15 to hoist the gutter cleaner apparatus 11 up near the roof and to insert the gutter cleaner apparatus 11 into the gutter 10. Since the vertical portions 21 and 27 of first and second forks 17 and 25, respectively, are inclined at the acute angle 67 with respect to the elongated handle 15 (as shown in FIG. 3); the apparatus 11 may be inserted into the gutter 11 so as to span the entire interior despite the roof overhang R. If vertical portions 21 and 27 were not so inclined but were instead parallel to the elongated handle 15, the apparatus 11 would be unable to clean a portion of the gutter directly beneath the roof overhang R.

Once the gutter cleaner apparatus 11 has been inserted into the gutter 10 so that the horizontal portion 23 of the first fork 17 is lying flat in the inside gutter bottom 10*d*, the second fork 25 is raised to its elevated position by lifting the operator's control handle 59. Handle 59 raises the elongated control rod 53 and turns the crank shaft 33 through a desired angle of rotation. With the second fork 25 so elevated, the operator proceeds to walk parallel to the longitudinal axis of the gutter 10 while holding the control handle 59 in a lifted position.

While the apparatus 11 is being slid along the interior of the gutter 10, apparatus 11 is maintained in the gutter 10 by the roller 37, which rides on the top edge 10*c* of the gutter 10, the second roller 39, and the vertical rollers 41 and 43, which ride on the exterior surface 10*b* of the gutter 10. Thus, only the rollers 37, 39, 41, and 43 contact the exterior of the gutter.

As the first fork 17 becomes filled with debris from the gutter 10, the operator stops the forward motion of the gutter cleaner apparatus 11 and lowers the second fork 25 into its closed position by lowering the operator's control handle 59. Handle 59 then lowers the elongated control rod 53, which rotates the crank shaft 33 to lower the second fork 25. Second fork 25 then engages the debris between the first fork 17 and the second fork 25.

Following engagement of the debris, the operator raises the elongated handle 15 while moving the handle 15 slightly away from the side of the gutter 10. The debris can then be deposited into a refuse container below. The operator then returns the gutter cleaner apparatus 11 to the gutter 10 where the cycle is repeated.

When the apparatus 11 encounters a gutter hanger spike 10*e* protruding transversely across the open top of the gutter 10, the gutter cleaner apparatus 11 is backed away from the hanger spike 10*e*, the second fork 25 is lowered to its closed position, and the gutter cleaner apparatus 11 is advanced so that pusher blade 47 pushes the debris from under the gutter hanger spike 10*e*. The apparatus 11 is then withdrawn from the gutter 10 and reinserted in the gutter 10 but on the other side of the spike 10*e* so that the first fork can be moved down and under the debris forward of the hanger spike.

If smaller items of debris such as seed pods and small leaves are encountered in the gutter 10, the brush accessory 74 with its L-shaped extension handle 75 can be mounted to the support plate 31 of the second fork 25 with the U-bolt fastener 51. The brush accessory 75 extends forward beyond the ends of both the first fork 17 and the second fork 25 and can be used to sweep the smaller particles of debris forward as the gutter cleaner apparatus 11 is moved therealong with the elongated handle 15.

The mirror accessory 78 affords the operator a view of the gutter 10 during any of the operation steps described above or whenever the operator desires to check the gutter interior for rust, deterioriation and the like. Since the mirror accessory 78 is attached to the pivotable second fork 25, rotation of the second fork 25 in the aforesaid manner enables the operator to scan the the gutter length. Further, since the mirror 79 is also pivotably mounted with respect to extension rod 81, the angle of reflection can be altered further as desired.

Extension handle 61 may be attached to the elongated handle 15 as described with reference to FIG. 2 in order to provide high altitude capability.

While a preferred embodiment is shown and described above, it is obvious that various changes might be made without departing from the scope of the present invention. For example, additional horizontal rollers 37 suspended from L-shaped brackets attached to the brace 45 may be added to give additional horizontal stability and support to the gutter cleaner apparatus.

The embodiments of the invention in which an exclusive property is claimed and defined are as follows:

1. Apparatus for remotely cleaning an overhead gutter, said apparatus comprising:

elongated handle means, said handle means having an top end and an bottom end adapted to be held by an operator;

first fork means rigidly attached to said top end of said handle means, and including a first portion substantially vertical with respect to the ground when said elongated handle means is held substantially vertically with respect to the ground; and, wherein said first portion of said first fork means and said elongated handle means intersect at a first acute angle in a substantially vertical plane containing said first portion of a first fork means and said elongated handle wherein said first fork means is adapted for insertion into said gutter and under a overhang thereover for slidable movement along the interior of said gutter;

second fork means pivotally attached to said top end of said handle means, said second fork means adapted for rotational motion with respect to said first fork means in order to selectively engage debris positioned between said first and second fork means as a result of the slidable movement of said apparatus;

control means operable from said bottom end of said handle for selectively rotating said second fork means and for imparting slidable movement to said apparatus along said overhead gutter;

wherein said first fork means includes a second portion integral with said first portion, said second portion being substantially horizontal with respect to the ground when said elongated handle means is held substantially vertically with respect to the ground; and, wherein said second fork means has affixed thereto a pusher member which extends substantially vertically with respect to the ground when said elongated handle means is held substantially vertically with respect to the ground and while said second fork means is in an essentially closed position with respect to said second portion of said first fork means whereby said apparatus is adapted to push debris from under gutter retainers when said apparatus slides thereunder during said slidable movement of said apparatus along said overhead gutter.

2. The apparatus of claim 1 wherein said pusher member is notched to accommodate an accessory attached to said apparatus.

3. Apparatus for remotely cleaning an overhead gutter, said apparatus comprising:

elongated handle means, said handle means having an top end and an bottom end adapted to be held by an operator;

first fork means rigidly attached to said top end of said handle means, and including a first portion substantially vertical with respect to the ground when said elongated handle means is held substantially vertically with respect to the ground; and, wherein said first portion of said first fork means and said elongated handle means intersect at a first acute angle in a substantially vertical plane containing said first portion of a first fork means and said elongated handle wherein said first fork means is adapted for insertion into said gutter and under a overhang thereover for slidable movement along the interior of said gutter;

second fork means pivotally attached to said top end of said handle means, said second fork means adapted for rotational motion with respect to said first fork means in order to selectively engage debris positioned between said first and second fork means as a result of the slidable movement of said apparatus;

control means operable from said bottom end of said handle for selectively rotating said second fork means and for imparting slidable movement to said apparatus along said overhead gutter; and, said second fork means having mounted thereon a fastener means for securing a brush member to said apparatus wherein said brush member is mounted on a first accessory extension means so that said brush member protrudes beyond said second fork means in a direction opposite from the attachment of said second fork means with said handle so that said brush member extends into an interior portion of said gutter as said apparatus is slid along said gutter.

4. Apparatus for remotely cleaning an overhead gutter, said apparatus comprising:

elongated handle means, said handle means having an top end and an bottom end adapted to be held by an operator;

first fork means rigidly attached to said top end of said handle means, and including a first portion substantially vertical with respect to the ground when said elongated handle means is held substantially vertically with respect to the ground; and, wherein said first portion of said first fork means and said elongated handle means intersect at a first acute angle in a substantially vertical plane containing said first portion of a first fork means and said elongated handle wherein said first fork means is adapted for insertion into said gutter and under a overhang thereover for slidable movement along the interior of said gutter;

second fork means pivotally attached to said top end of said handle means, said second fork means adapted for rotational motion with respect to said first fork means in order to selectively engage debris positioned between said first and second fork means as a result of the slidable movement of said apparatus;

control means operable from said bottom end of said handle for selectively rotating said second fork means and for imparting slidable movement to said apparatus along said overhead gutter; and, said second fork means having mounted thereon a fastener means for securing a mirror member mounted on a secondary accessory extension means so that said mirror member protrudes above said gutter and pivots with said second fork means wherein pivotal motion of said second fork means enables an operator to scan the gutter.

5. Apparatus for remotely cleaning an overhead gutter, said apparatus comprising:

elongated handle means, said handle means having an top end and an bottom end adapted to be held by an operator;

first fork means rigidly attached to said top end of said handle means, and including a first portion substantially vertical with respect to the ground when said elongated handle means is held substantially vertically with respect to the ground; and, wherein said first portion of said first fork means and said elongated handle means intersect at a first acute angle in a substantially vertical plane containing said first portion of a first fork means and said elongated handle wherein said first fork means is adapted for insertion into said gutter and under a overhang thereover for slidable movement along the interior of said gutter;

second fork means pivotally attached to said top end of said handle means, said second fork means adapted for rotational motion with respect to said first fork means in order to selectively engage debris positioned between said first and second fork means as a result of the slidable movement of said apparatus;

control means operable from said bottom end of said handle for selectively rotating said second fork means and for imparting slidable movement to said apparatus along said overhead gutter;

wherein said first fork means is attached to said top end of said handle means by a first bracket member, and wherein said second fork means is attached to a second bracket member, said second bracket member being secured to a crank member, said crank member being connected by an elongated control rod to said control means operable from said bottom end of said handle means, said crank member also being mounted for rotation between two crank support members, said crank support members being rigidly affixed to said first bracket.

6. The apparatus of claim 5 wherein said control means includes a control handle which substantially surrounds said elongated handle and slides vertically therealong.

* * * * *